United States Patent [19]

Holman et al.

[11] Patent Number: 4,525,014

[45] Date of Patent: Jun. 25, 1985

[54] AIRCRAFT GROUNDING RECEPTACLE

[75] Inventors: Howard E. Holman; Roy D. Turner, both of Fort Worth, Tex.

[73] Assignee: T. J. Electronics, Arlington, Tex.

[21] Appl. No.: 569,603

[22] Filed: Jan. 10, 1984

Related U.S. Application Data

[63] Continuation-in-part of Ser. No. 466,915, Feb. 16, 1983.

[51] Int. Cl.[3] ..... H01R 4/66

[52] U.S. Cl. ..... 339/14 R; 339/129; 361/218

[58] Field of Search ..... 339/14 R, 182 R, 126, 339/129, 130; 361/215-218; 403/194, 197, 195, 201, 233, 239; 285/161, 206; 200/51.09

[56] References Cited

U.S. PATENT DOCUMENTS

| | | | |
|---|---|---|---|
| 1,075,612 | 10/1913 | Tregoning | 339/129 |
| 1,079,483 | 11/1913 | Freeman | 339/129 |
| 1,564,855 | 12/1925 | Jurs | 361/215 |
| 1,564,925 | 12/1925 | Anthony | 361/215 |
| 1,749,179 | 3/1930 | Davis, Jr. | 361/215 |
| 1,785,729 | 12/1930 | Davis, Jr. | 361/215 |
| 2,434,534 | 1/1948 | Alford | 339/113 B |
| 2,454,465 | 11/1948 | Leo et al. | 285/206 X |
| 2,958,843 | 11/1960 | Long | 339/61 R |
| 3,038,972 | 6/1962 | Lagier | 200/51.09 |
| 3,145,329 | 8/1964 | Deakin et al. | 357/74 |
| 3,258,734 | 6/1966 | Greasley | 339/176 R |
| 4,312,558 | 1/1982 | Duerr et al. | 403/192 X |

*Primary Examiner*—Eugene F. Desmond
*Attorney, Agent, or Firm*—Gardere & Wynne

[57] ABSTRACT

A first embodiment of an aircraft grounding receptacle (10) comprises a connector portion and a tubular portion (18). The connector portion (12) includes an external thread (14) and a hexagonal portion (16). The tubular portion includes a reduced diameter portion (40) and a hexagonal flange (24). Four slots (34) separate the tubular portion (18) into four tines (26,28,30,32) and intersect the flange (24) at locations spaced apart from four of the six points comprising the hexagonal shape of the flange. A bore (38) extends through the body for receiving an aircraft grounding plug (52) and includes reduced diameter portions (40,41) for mating engagement with the terminal groove (54) of the plug.

A second embodiment of the aircraft grounding receptacle (60) comprises a plug receiving portion (62) and a collet portion (64). The plug receiving portion includes a flange (66) adapted for engagement with the interior surface (82) of an aircraft panel (80) and having a surface (70) sloping inwardly toward the collet portion (64). An extension (72) projects through an aperture (128) in the aircraft panel (80) and has a hexagonal internal bore (84). The collet portion (64) includes a plurality of segments adapted to matingly receive an aircraft gounding plug therein. A washer (120) receives the receptacle therethrough and includes a dimple (122) which engages the sloping surface (70) of the flange (66). The dimple (122) of the washer (120) is trapped between the sloping surface (70) of the flange (66) and a housing (110) which surrounds the collet portion (64) of the receptacle (60). The washer (120) is secured to the aircraft receptacle (60) by a plurality of rivets (126).

6 Claims, 8 Drawing Figures

AIRCRAFT GROUNDING RECEPTACLE

CROSS REFERENCE TO RELATED APPLICATION

This application is a continuation-in-part of copending application Ser. No. 466,915, filed Feb. 16, 1983.

TECHNICAL FIELD

This invention pertains to an aircraft grounding receptacle for mounting on an aircraft and for receiving an aircraft grounding plug to effect a grounding connection during fueling operations.

BACKGROUND AND SUMMARY OF THE INVENTION

In the fueling of aircraft it is necessary to form a grounding connection between the aircraft and the fueling apparatus. Otherwise, a charge of static electricity can build up, leading to an electrical arc or spark discharge. This can cause ignition of the fuel, resulting in damage to the equipment and injury or death of personnel.

At the present time, the grounding of an aircraft during fueling is accomplished using a plug comprising an elongate cylinder formed from electrically conductive metal and having a terminal groove surrounding its distal end. The plug is received in a receptacle mounted on the aircraft which comprises a brass fitting having a beryllium copper spring staked or riveted thereto. The spring is in the form of a hook and includes a rounded tip adapted for engagement with the terminal groove of the plug to form an electrical and mechanical connection between the plug and the receptacle.

It has been found that the present receptacle design incorporates a number of highly disadvantageous characteristics. First, the beryllium copper spring forms an electrical connection with the plug by means of a single point contact. If disengagement between the spring and the plug should occur for any reason, for example, due to vibration or otherwise, an electrical arc can form resulting in ignition of the fuel.

Other disadvantages result from the use of dissimilar metals to form the component parts of the receptacle. Such dissimilar metal construction can lead to increased electrical resistance. Also, because of its two-piece construction, the receptacle is subject to damage if excessive torque is used during installation. Still another disadvantage inherent in the present design involves the fact that only a limited amount of mechanical force can be applied through the beryllium copper spring against the plug which can lead to increased electrical resistance at the point of contact between the spring and the plug.

The present invention comprises an aircraft grounding receptacle which eliminates the foregoing and other problems long since associated with the prior art. In accordance with a first embodiment of the invention, an aircraft grounding receptacle is machined from a unitary length of bar stock comprising an electrically conductive material. The receptacle includes a connecting portion and a tubular portion extending from the connecting portion to a flange situated at the opposite end of the receptacle. A passageway extends through the receptacle to reduced diameter portions situated adjacent to the flange and adapted to matingly receive the terminal groove of an aircraft grounding plug. Four slots extend into the tubular portion from the flange to permit the segments of the tubular portion to flex outwardly to receive and grip the grounding plug.

In accordance with a second embodiment of the invention, an aircraft grounding receptacle is likewise machined from a unitary length of bar stock comprising an electrically conductive material. The receptacle includes a plug receiving portion and a collet portion. The plug receiving portion of the receptacle includes a flange comprising a first surface extending perpendicularly to the axis of the receptacle and a second surface which slopes toward the collet portion. The plug receiving portion further includes an extension which projects through an aperture formed in an aircraft panel when the first surface of the flange engages the interior surface of the panel. The collet portion includes a reduced diameter section adapted to matingly receive an aircraft grounding plug and is provided with four longitudinally extending slots which allow the reduced diameter portion to expand outwardly to matingly receive the distal end of the plug. The exterior of the receptacle is threaded to receive a housing which surrounds the collet portion. A washer is captured between the second surface of the flange and the housing and is secured to the panel of the aircraft by rivets.

The use of the present invention results in numerous advantages over the prior art. First, when an aircraft grounding plug is received in a receptacle incorporating the present invention, a total of eight contact points are established between the receptacle and the plug. This eliminates the possibility that a single point contact will somehow become disengaged, leading to spark discharge. Second, the grounding plug is gripped by four contact tines arranged in two opposed groups, thereby substantially eliminating the possibility of disengagement between the plug and the receptacle. Third, substantially greater mechanical contact pressure between the plug and the receptacle is achieved by means of the invention, which in turn reduces the electrical resistance between the plug and the receptacle. Finally, the present invention comprises a one-piece construction. This provides a receptacle which is capable of withstanding up to twenty times as much mechanical torque as is the case with prior designs, while simultaneously eliminating the problem of increased electrical resistance which can result when dissimilar metals are used in fabricating a grounding receptacle.

BRIEF DESCRIPTION OF THE DRAWINGS

A more complete understanding of the invention may be had by reference to the following Detailed Description when taken in conjunction with the accompanying Drawings, wherein.

DETAILED DESCRIPTION

Figure 4:
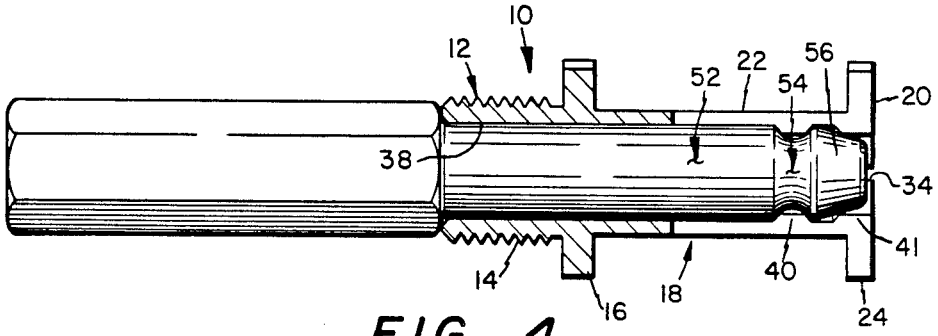
FIG. 4 is a longitudinal sectional view showing a grounding plug installed in the receptacle of FIG. 2.

Referring now to the drawings, and particularly to FIG. 4 thereof, there is shown an aircraft grounding receptacle 10 incorporating a first embodiment of the invention. The receptacle 10 comprises a unitary length of electrically conductive metal. In accordance with the preferred embodiment, the receptacle 10 is formed from beryllium copper alloy.

The receptacle 10 includes a connector portion 12. In the first embodiment of the invention, the connector portion 12 comprises an external thread 14. However, other conventional types of connectors may be utilized in the practice of the invention, if desired. The connector portion 12 further includes a hexagonal portion 16. The hexagonal portion 16 is adapted for mating engagement with a suitable wrench or other tool to facilitate installation or removal of the receptacle 10.

A tubular portion 18 extends from the connector portion 12 to the distal end 20 of the receptacle 10. The tubular portion 18 includes a section 22 which is circular in cross-section. The tubular portion 18 further includes a hexagonal flange 24 situated at the end 20 of the receptacle 10. The tubular portion 18 is separated into four tines, 26, 28, 30 and 32, by four slots 34.

Figure 3:
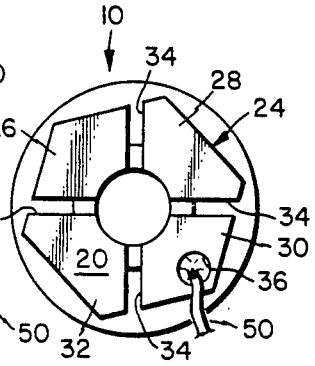
FIG. 3 is an end view of the receptacle of FIG. 2.

As is best shown in FIG. 3, the four slots 34 are situated at 90° intervals around the periphery of the receptacle 10. In actual practice, opposed slots 34 may be formed simultaneously. The slots 34 intersect the hexagonal flange 24 at points adjacent to but not coincident with four of the six points defining the hexagonal shape of the flange. The portion of the flange 24 comprising the tine 30 of the tubular portion 18 of receptacle 10 is provided with a hole 36 which may be used to receive a grounding wire or lead. A similar grounding wire hole may be formed in the portion of the flange 24 comprising the tine 26, if desired.

Referring again to FIG. 4, a circular bore 38 is formed through the receptacle 10. The bore 38 is of uniform diameter through the connector portion 12 and through most of the tubular portion 18 of the receptacle 10. The bore 38 includes a reduced diameter portion 40 situated adjacent the distal end 20 of the receptacle 10 and inwardly from the hexagonal flange 24. The reduced diameter portion 40 is positioned and dimensioned for mating engagement with the terminal groove of an aircraft grounding plug, whereby the aircraft grounding plug is securely retained in engagement with receptacle 10. Another reduced diameter portion 41 of the bore 38 is located at the end 20 of the receptacle 10 within the flange 24.

As stated, the receptacle 10 is preferably formed from a single piece of electrically conductive material, for example, beryllium copper. The receptacle 10 may conveniently be formed utilizing a machine tool such as an automatic screw machine. The receptacle 10 may be formed on such a machine tool from a length of hexagonal bar stock having original external dimensions identical to those of the hexagonal portion 16 and the hexagonal flange 24 of the receptacle 10. By means of such a machine tool, the receptacle 10 may be manufactured by completely automatic techniques requiring no hand or manual operations whatsoever.

In certain applications of the invention, it may be desirable to cover the machined aircraft grounding receptacle 10 with a plating layer. For example, in one version of the invention the receptacle 10 is plated with cadmium. In another version of the invention the finished receptacle 10 is plated with silver. It will be understood that the receptacle 10 may be manufactured from materials other than beryllium copper, and that the receptacle 10 may be plated with materials other than cadmium and silver, in accordance with the requirements of particular applications of the invention.

Figure 1:
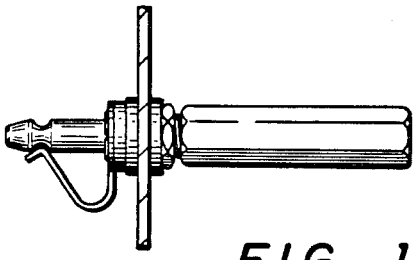
FIG. 1 (PRIOR ART)
FIG. 1 is an illustration of a prior art grounding receptacle and grounding plug.
Figure 2:
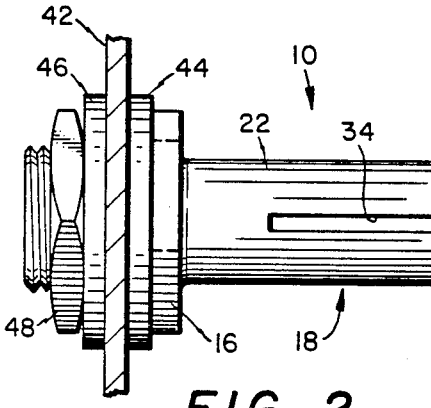
FIG. 2 is a side view of an aircraft grounding receptacle incorporating a first embodiment.

The installation of the aircraft grounding receptacle 10 is illustrated in FIG. 2. The connector portion 12 of the receptacle 10 is inserted through a suitably dimensioned aperture formed in a panel 42 of an aircraft, or the like. A washer 44 is positioned on the connector portion 12 between the panel 42 and the hexagonal portion 16. Another washer 46 is positioned on the connector portion 12 on the opposite side of the panel 42. Either washer 44 or washer 46 may be a lock washer. A nut 48 is threadedly engaged with the threads 14 of the connector portion 12 to secure the receptacle 10 in place. Wrenches or similar tools are engaged with the hexagonal portion 16 of the connector portion 12 of the receptacle 10 and with the nut 48 and are used to tighten the nut 48 sufficiently to secure the receptacle 10 to the panel 42. In the practice of the invention it has been found that because of its one-piece construction, the receptacle 10 is capable of withstanding approximately twenty times as much torque as is the case in the use of prior aircraft grounding receptacle designs.

If the panel 42 is formed from electrically conductive material and is sufficiently grounded, no additional electrical connection to the receptacle 10 is necessary. However, if the panel 42 is formed from an electrically nonconductive material or if the panel 42 is not sufficiently grounded, a grounding wire or lead 50 is used to form a grounding connection to the receptacle 10. The grounding wire 50 is connected to the receptacle 10 by inserting the wire 50 through the hole 36 in the portion of the flange 24 comprising the tine 30 of the tubular portion 18 and then soldering the wire 50 in place. The grounding wire 50 is in turn extended to a grounded portion of the aircraft, for example, the engine. It will be understood that other techniques may be employed for forming a grounding connection to the receptacle 10, in acordance with the requirements or particular applications of the invention.

In the use of the aircraft grounding receptacle 10, an aircraft grounding plug 52 is inserted into the bore 38. The outside diameter of the plug 52 is substantially matched to the inside diameter of the main portion of the bore 38. As the end of the plug 52 engages the reduced diameter portion 40 of the bore 38 the tines 26, 28, 30 and 32 comprising the tubular portion 18 of the receptacle 10 are flexed outwardly. Then, as the terminal groove 54 of the plug 52 comes into alignment with the reduced diameter portion 40 of the receptacle 10, the tines flex inwardly to securely grip the plug 52 in the receptacle 10 with the tip 56 of the plug 52 secured between the reduced diameter portions 40 and 41 of the bore 38.

Upon its insertion into the receptacle 10, the aircraft grounding plug 52 is gripped between two sets of opposed tines. That is, the plug is gripped between the tines 26 and 30 and is simultaneously gripped between the tines 28 and 32 comprising the tubular portion 18 of the receptacle 10. By this means, the aircraft grounding plug 52 is substantially prevented from disengagement from the receptacle 10.

The amount of electrical resistance between the receptacle 10 and the plug 52 inserted therein depends at least to some extent on the contact pressure between the tines 26, 28, 30 and 32 and the plug 52. In the practice of the invention this contact pressure is determined by the length of the slots 34, that is, the extent to which the slots 34 extend into the tubular portion 18 of the receptacle 10 from the end 20, and also upon the thickness of the tubular portion 18 in the section 22. In the practice of the present invention it is possible to employ considerably greater contact pressure between the tines of the receptacle 10 and the plug 52 than is the case when prior grounding receptacle designs are used. This increased contact pressure substantially reduces the electrical resistance between the receptacle and the plug.

In actual practice it has been found that the aircraft grounding receptacle 10 of the present invention forms a total of eight contact points with an aircraft grounding plug 52 inserted therein. These eight contact points are situated on opposite sides of each of the four slots 34. This may be contrasted with the single contact point which is typical of most prior aircraft grounding receptacle designs. At least in part because of the eight contact point feature of the present invention, a continuous electrical connection between the receptacle 10 and the plug 52 is assured notwithstanding excessive vibration, mechanical shock, etc.

A feature of the embodiment of FIGS. 2, 3 and 4 which is of particular importance comprises the hexagonal flange 24 and the manner in which the slots 34 intersect the flange 24. The flange 24 provides relatively heavy end portions for the tines 26, 28, 30 and 32 which serves to dampen any movement of the segments in response to vibration. Perhaps more importantly, the portions of the flange 24 comprising the tines 26, 28, 30 and 32 serve to prevent harmonic response of the segments to engine vibrations or other vibrations which may occur within the aircraft, and thereby assures continuous electrical contact between the receptacle 10 and the aircraft grounding plug 52.

Referring now to FIGS. 5, 6, 7, and 8, there is shown an aircraft grounding receptacle 60 incorporating a second embodiment of the invention. The receptacle 60 is adapted for use in conjunction with an aircraft grounding plug 52 of the type illustrated in FIG. 4 and described hereinabove in conjunction therewith. The plug 52 has a terminal groove 54 and a tip 56 extending beyond the terminal groove 54. The plug 52 is formed from an electrically conductive material and typically has a grounding lead 50 extending therefrom.

Figure 7:
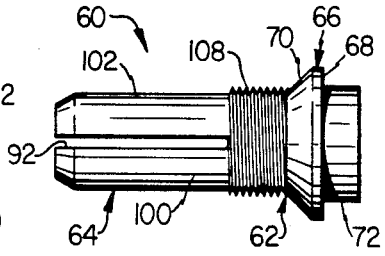
FIG. 7 is a side view of the receptacle of FIG. 5.

Referring particularly to FIG. 7, the receptacle 60 includes a plug receiving portion 62 and a collet portion 64. The plug receiving portion 62 includes a flange 66 comprising a first surface 68 extending perpendicularly to the axis of the receptacle 60 and a second surface 70 which slopes rearwardly toward the collet portion 64. The plug receiving portion 62 further includes an extension 72 extending from the flange 66 in the direction opposite from that of the collet portion 64.

Figure 5:
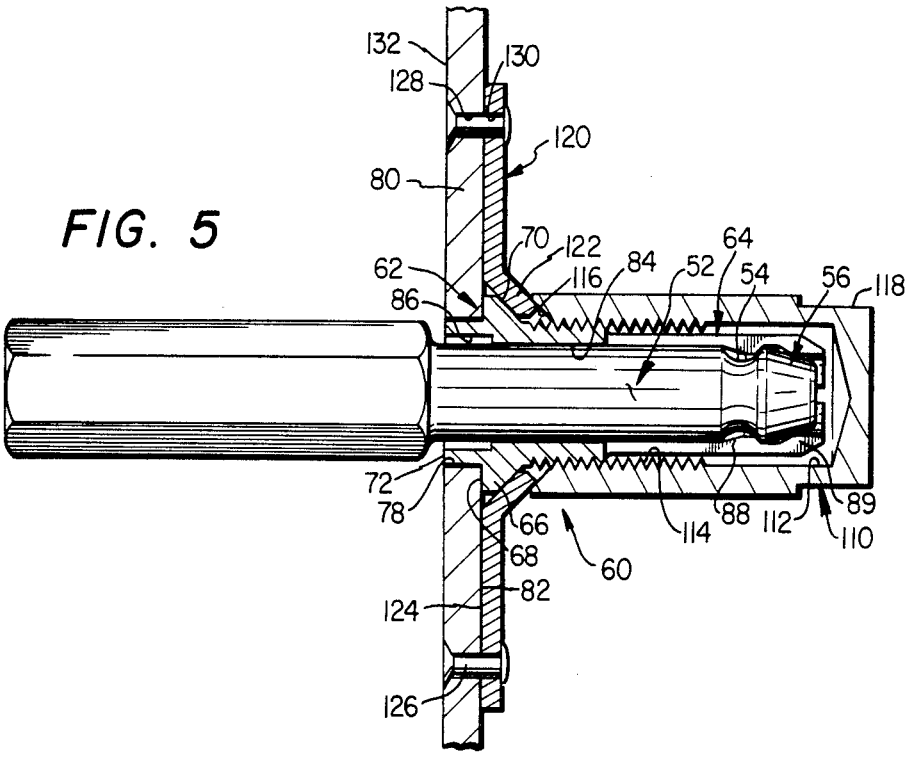
FIG. 5 is a view similar to FIG. 4 illustrating an aircraft grounding receptacle comprising a second embodiment of the invention.
Figure 8:
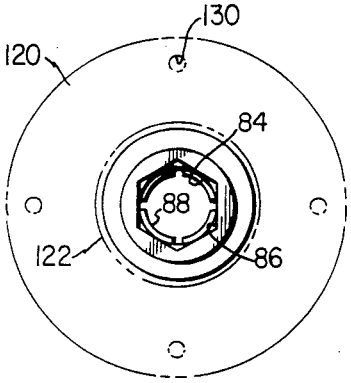
FIG. 8 is an end view of the receptacle of FIG. 5 illustrating the plug receiving portion thereof.

As is best shown in FIG. 5, the extension 72 of the plug receiving portion 62 of the receptacle 60 is adapted to extend through an aperture 78 formed in an aircraft panel 80 when the surface 68 of the flange 66 is engaged with the interior surface 82 of the panel 80. Both the plug receiving portion 62 and the collet portion 64 of the receptacle 60 are characterized by a bore 84 having an inside diameter which is substantially matched to the outside diameter of plug 52. As is best shown in FIG. 8, the extension 72 is provided with a hexagonal bore 86 adapted to receive a hexagonal wrench (not shown) to facilitate the installation of the receptacle 60.

Figure 6:
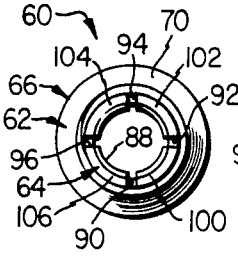
FIG. 6 is an end view of the receptacle of FIG. 5 illustrating the collet portion thereof.

The collet portion 64 of the receptacle 60 comprises reduced diameter portions 88 and 89 adapted to receive and securely grip both the terminal groove 54 and the tip 56 of the plug 52. As is best shown in FIG. 6, four slots 90, 92, 94 and 96 extend longitudinally into the receptacle 60 to define the collet portion 64 thereof. The slots 90, 92, 94 and 96 divide the collet portion 64 into four tines 100, 102, 104 and 106. The slots 90, 92, 94 and 96 allow the tines 100, 102, 104 and 106 to flex outwardly to receive the tip 56 of the plug 52 as the plug 52 is inserted into the receptacle 60, and thereafter allow the tines 100, 102, 104 and 106 to flex inwardly to securely grip the tip 56 and the terminal groove 54 of the plug 52 in the collet portion 64 of the receptacle 60. By reference to FIGS. 5 and 6 it will be understood that the collet portion 64 of the receptacle 60 establishes metal to metal contact with the plug 52 at at least eight separate points, thereby assuring excellent electrical communication between the plug 52 and the receptacle 60 regardless of such conditions such as vibration, shock, metal fatigue, etc.

Referring simultaneously to FIGS. 5 and 7, the receptacle 60 includes an externally threaded portion 108 extending from the surface 70 of the flange 66 toward the collet portion 64. A housing 110 has an internal bore 112 adapted to receive the collet portion 64 of the receptacle 60 therein and is internally threaded at 114 for threaded engagement with the external threads 108 of the receptacle 60. In this manner the housing 110 is securely retained in engagement with the receptacle 60 to provide an enclosure surrounding the collet portion 64 of the receptacle 60 and the terminal groove 54 and the tip 56 of the plug 52 received therein.

A washer 120 is formed from an electrically conductive material and includes a dimple 122 which matingly receives the inclined surface 70 of the flange 66 of the plug receiving portion 62 of the receptacle 60. The housing 110 has an outwardly angularly extending surface 116 at the leading end of the threads 114 and a wrench receiving portion 118 at the opposite end thereof. The dimple 122 of the washer 120 is trapped between the surface 70 and the surface 116 of the housing 110 when the housing 110 is threadedly engaged with the receptacle 60. The washer 120 further includes a surface 124 which engages the interior surface 82 of the aircraft panel 80. The washer 120 and therefore the receptacle 60 and the housing 110 are secured in place by a plurality of rivets 126 which are received through apertures 128 formed in the aircraft panel 80 and apertures 130 formed in the washer 120. The rivets 126 are preferably of the flat head variety so that the external surface 132 of the aircraft panel 80 is entirely flush.

In the use of the receptacle 60, the extension 72 is first positioned within the aperture 78 formed in the aircraft panel 80. The washer 120 is then positioned around the receptacle 60 with the dimple 122 engaging the surface 70 of the flange 66. The washer 120 is secured in place by means of the rivets 126. The housing 110 is then threadedly engaged with receptacle 60 thereby trapping the dimple 122 of the washer 120 between the surface 70 and the surface 116 of the housing 110. Threaded engagement of the housing 110 with the receptacle 60 is facilitated by means of a first hexagonal wrench received in the hexagonal bore 86 formed in the extension 72 of the receptacle 60 and a second wrench which receives the portion 118 of the housing 110.

Following installation, the receptacle 60 is adapted to receive an aircraft grounding plug 52 therein. The plug 52 is inserted through the plug receiving portion 62 of the receptacle 60 and into the collet portion 64 thereof. Movement of the tip 56 and of the plug 52 into the reduced diameter portion 88 of the collet portion 64 is facilitated by the slots 90, 92, 94 and 96 which allow the tines 100, 102, 104 and 106 to flex outwardly. When the plug 52 is positioned relative to the receptacle 60 as shown in FIG. 5, the tines 100, 102, 104 and 106 flex inwardly to securely grip the terminal groove 54 and the tip 56 in the collet portion 64 of the receptacle 60.

An important feature of the present invention relates to its one-piece construction. Many prior aircraft grounding receptacle designs employ component parts which are formed from dissimilar metals. This can lead to increased electrical resistance. Also, the use of two or more component parts leads to mechanical weakness which is totally absent in the present invention. Further, the one-piece construction requires considerably less adjustment of the contact pressure and the positioning of inserted plugs than do prior art receptacles.

Although particular embodiments of the invention have been illustrated in the accompanying Drawings and described in the foregoing Detailed Description, it will be understood that the present invention is not limited to the embodiments disclosed, but is capable of numerous rearrangements, modifications, and substitutions of parts and elements without departing from the spirit of the invention.

We claim:

1. An aircraft grounding receptacle comprising:

a unitary body of electrically conductive material;

said body of electrically conductive material including a plug receiving portion and a collet portion;

the plug receiving portion including a flange characterized by a first surface extending perpendicularly to the axis of the receptacle and adapted for engagement with the internal surface of an aircraft panel and a second surface sloping inwardly toward the collet portion;

said plug receiving portion further including an extension projecting from the flange in the opposite direction from the collet portion and adapted to project through an aperture in the aircraft panel;

the collet portion having reduced diameter portions adapted to matingly receive the terminal groove and the tip of an aircraft grounding plug therein;

said collet portion further comprising a plurality of longitudinally extending slots defining a plurality of tines therebetween adapted to flex outwardly when an aircraft grounding plug is inserted into the collet portion of the receptacle and to thereafter flex inwardly to securely retain the tip and the terminal groove in the reduced diameter portions of the collet portion;

a washer having the receptacle extending therethrough and including a dimple positioned for engagement with the second surface of the flange of the plug receiving portion of the receptacle;

means securing the washer to the aircraft panel; and a housing mounted on the receptacle and surrounding the collet portion thereof.

2. The aircraft grounding receptacle according to claim 1 wherein the receptacle is externally threaded and the housing is internally threaded and wherein the housing is retained in engagement with the receptacle by threaded engagement between the external and internal threads thereof.

3. The aircraft grounding receptacle according to claim 1 wherein the dimple of the washer is trapped between the second surface of the flange of the plug receiving portion of the receptacle and the housing.

4. The aircraft grounding receptacle according to claim 1 wherein the means securing the washer to the aircraft panel comprises a plurality of rivets.

5. The aircraft grounding receptacle according to claim 1 wherein the extension of the plug receiving portion of the receptacle is further characterized by a hexagonal internal bore for receiving a wrench therein, and wherein the housing has a wrench receiving portion to facilitate assembly of the housing onto the receptacle.

6. An aircraft grounding receptacle comprising:

a unitary body of electrically conductive material;

said body of electrically conductive material including a plug receiving portion and a collet portion;

the plug receiving portion including a flange characterized by a first surface extending perpendicularly to the axis of the receptacle and adapted for engagement with the internal surface of an aircraft panel and a second surface sloping inwardly toward the collet portion;

said plug receiving portion further including an extension projecting from a flange in the opposite direction from the collet portion and adapted to project through an aperture in the aircraft panel;

said extension of the plug receiving portion of the receptacle being characterized by a hexagonal internal bore for receiving a wrench therein;

the collet portion of the receptacle having reduced diameter portions adapted to matingly receive the terminal groove and the tip of a aircraft grounding plug therein;

said collet portion further comprising a plurality of longitudinally extending slots defining a plurality of tines therebetween adapted to flex outwardly when an aircraft grounding plug is inserted into the collet portion of the receptacle and thereafter flex inwardly to securely retain the tip and the terminal groove of the plug in the reduced diameter portions of the collet portion;

a washer having the receptacle extending therethrough and including a dimple positioned in engagement with the second surface of the flange of the plug receiving portion of the receptacle;

a plurality of rivets securing the washer to the aircraft panel;

a housing surrounding the collet portion of the receptacle;

said receptacle being externally threaded and said housing being internally threaded, said housing being secured to the receptacle by threaded engagement of the internal and external threads thereof;

said dimple of the washer being trapped between the housing and the second surface of the flange of the plug receiving portion of the receptacle; and said housing including a wrench receiving portion for facilitating threaded engagement of the housing with the receptacle.

* * * * *